US005657567A

United States Patent [19]

Beretta

[11] Patent Number: 5,657,567

[45] Date of Patent: Aug. 19, 1997

[54] DEVICE FOR COUPLING AND RELEASING THE TRIGGER MECHANISM IN THE BASCULE OF GUNS

[75] Inventor: Ugo Gussalli Beretta, Brescia, Italy

[73] Assignee: Fabbrica d'Armi P. Beretta S.P.A., Brescia, Italy

[21] Appl. No.: 559,141

[22] Filed: Nov. 17, 1995

[30] Foreign Application Priority Data

Feb. 2, 1995 [IT] Italy ..... BS95A0013

[51] Int. Cl.[6] ..... F41A 19/11

[52] U.S. Cl. ..... 42/41; 42/44; 42/70.01; 42/69.01

[58] Field of Search ..... 42/8, 40, 44, 42.01, 42/70.01, 41, 75.04, 70.06, 69.01

[56] References Cited

U.S. PATENT DOCUMENTS

| | | | |
|---|---|---|---|
| 3,776,677 | 12/1973 | Waddell | 42/75.04 |
| 4,646,457 | 3/1987 | Verney-Carron | 42/41 |
| 4,662,098 | 5/1987 | Timari | 42/69.01 |
| 4,811,511 | 3/1989 | Beretta | 42/70.06 |

FOREIGN PATENT DOCUMENTS 0 277 921 B1 12/1991 European Pat. Off. .

*Primary Examiner*—Michael J. Carone
*Assistant Examiner*—Christopher K. Montgomery
*Attorney, Agent, or Firm*—McGlew & Tuttle

[57] ABSTRACT

The present invention pertains to a device for coupling the trigger mechanism in the bascule (10) of guns, which comprises a kinematic mechanism (26, 27, 31) which extends between the locking sliding safety catch (19) of the trigger guard to move the locking bolt of the trigger guard (19) into a backward position for releasing the trigger mechanism followed by a consecutive movement of the sliding safety catch (15) from an intermediate firing position (A) to a forward release position (B) and of the closing top lever (18) into a position for unlocking the barrels.

5 Claims, 6 Drawing Sheets

F
10
11
12
14
14'
15
16
18
19
19'
19b
21
24
25
26
27
31
32
33

A
D
10
15
18
18a
27

DEVICE FOR COUPLING AND RELEASING THE TRIGGER MECHANISM IN THE BASCULE OF GUNS

FIELD OF THE INVENTION

The present invention concerns the field of guns and pertains, in particular, to a device for coupling and releasing the trigger mechanism in the bascule of guns.

BACKGROUND OF THE INVENTION

In the field of shotguns and over-and-under or coupled double-barreled shotguns, usually either single-trigger or double-trigger trigger mechanisms are used, which are mounted on a support, called the trigger guard, which can be attached to the lower part of the bascule of the gun corresponding to a suitable opening or space. The fixing into position of the trigger guard and, by means of this, of the trigger mechanism, is carried out generally, on the one hand, by the joint insertion of a tab in front of the trigger guard into a complementary seat provided in the bascule and, on the other hand, by attaching the end of the trigger guard to the bascule by means of a coupling system.

The above makes it possible to mount and to remove the trigger mechanism on the guns as a block unit.

An example of a coupling and releasing device having the above-mentioned function has become known from EP-A-277,921.

A sliding safety catch, mounted and movable in the upper part of the bascule and having its own part intended for interfering with an element of the trigger mechanism in order to inhibit the use of the latter when the gun is put on safety, is also generally coordinated with the trigger mechanism of the guns.

On the other hand, the barrels are pivoted on the bascule, rotating between a dosing position and an opening position. A top lever mounted on the bascule is provided for loading the barrels when closed and for unloading when they must be opened.

However, in the prior-art devices, the releasing of the trigger mechanism for its removal from the bascule may also be carried out not under conditions of maximum safety. In fact, such a release may also be carried out with the gun closed and when a hand of the user may interfere with the trigger, thus with the risk of involuntarily and accidentally causing the firing of a cartridge in the barrel. The same lack of safety may also be found in the attachment of the trigger mechanism to the bascule.

SUMMARY AND OBJECTS OF THE INVENTION

The primary object of the present invention is to eliminate such a possibility and at making it possible to couple and remove the trigger mechanism from the bascule only under conditions of maximum safety and without the possibility of accidentally firing shots in the barrel.

In fact, the purpose of the present invention is to provide a device for coupling and releasing the trigger mechanism in a bascule of guns, with which:

the release of the trigger mechanism is possible only by acting simultaneously, with double action, on the sliding safety catch and on the top lever for opening the barrels;

the hands of the user are both occupied with carrying out such a double action on the sliding safety catch and on the top lever for opening the barrels;

the double action must be carried out with the hands of the user away from the trigger in order not to interfere with the trigger; and finally, the removal and mounting of the trigger mechanism may be carried out only with the barrels open, thus with the gun in the inoperative state.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
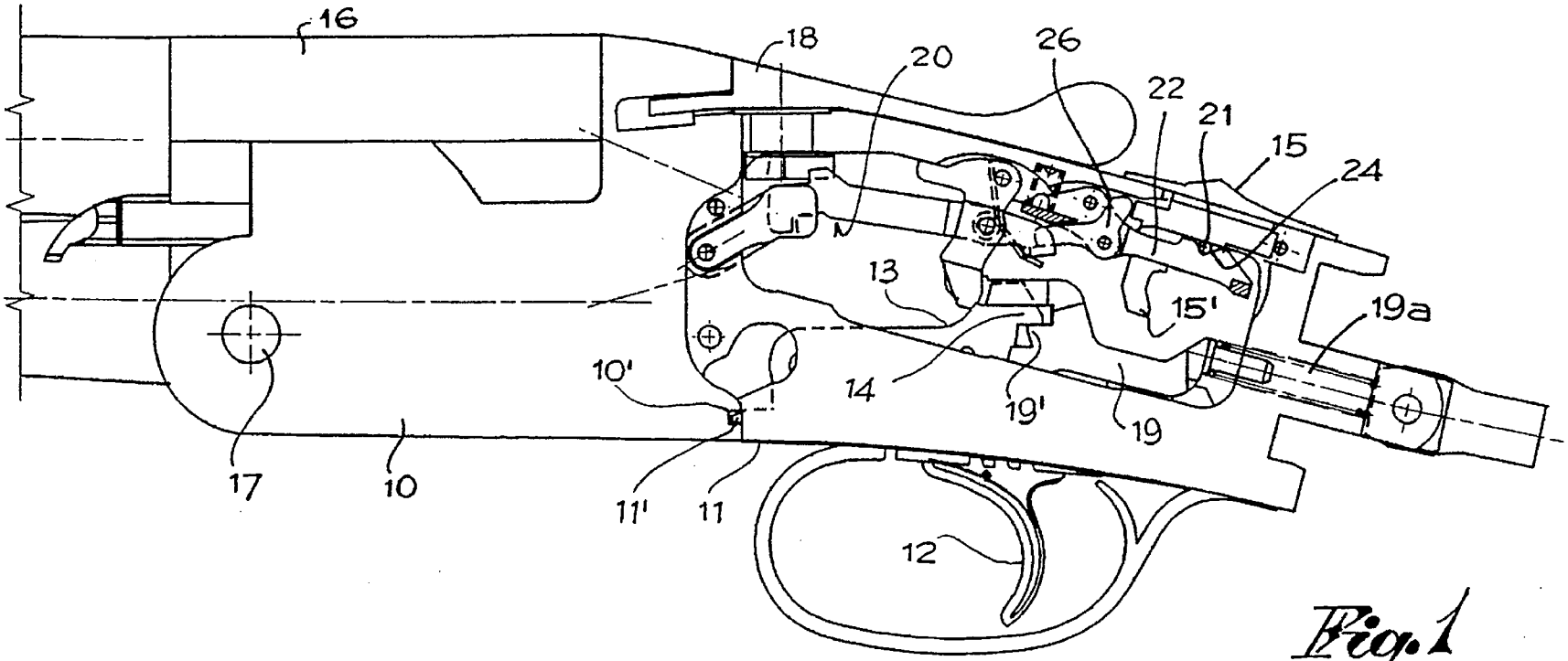
FIG. 1 is a schematic view of the device according to the present invention attached to a gun with a single-trigger trigger mechanism, with the gun being ready for use.
Figure 1A:
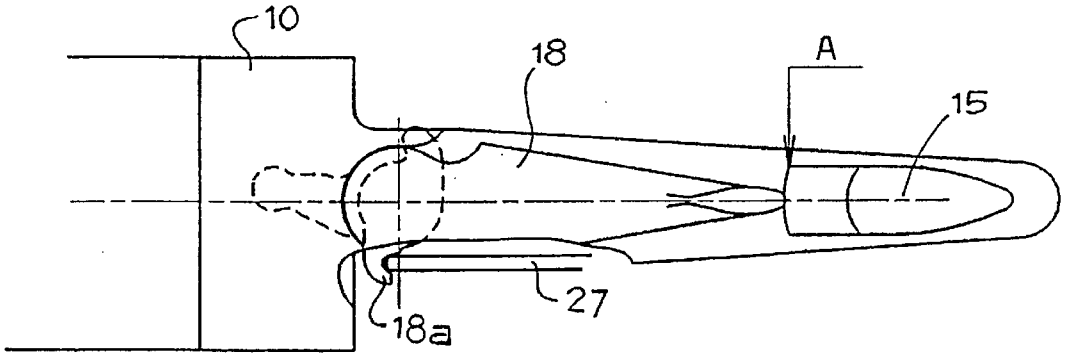
FIG. 1*a* is a partial top view of the device in FIG. 1 to demonstrate the position of the top lever for closing the barrels.

Referring to the drawings in particular, 10 designates the bascule of a gun, in which is mounted a trigger mechanism, whose components are premounted on a trigger guard 11, which can be attached to the lower part of the bascule 10.

The trigger mechanism can include a single trigger, as shown in the drawings, or a double trigger. Its components have been omitted for greater clarity, and are, moreover, well known to the persons skilled in the art. The components of the trigger mechanism shown are only the trigger guard 11, which supports a trigger 12 and has a baffle 13, which rises inside the bascule and which has a hook 14, facing towards the rear and provided with a top bevel 14'.

A sliding safety catch 15, which has a catch part 15' intended for interfering, in a known manner, with a component of the trigger mechanism for putting the gun on safety, is mounted and can be moved in the upper part of the bascule 10.

The barrels 16 of the gun, which can be moved by rotating on a pin 17 between a closing position and an opening position, are pivoted on the front part of the bascule.

A rotating top lever 18 attached to the bascule 10 is provided for locking and unlocking the barrels in the usual manner when they are closed.

For the attachment of the trigger mechanism to the bascule, the trigger guard 11 has a tab 11' in front intended for being joint-inserted into a complementary seat 10' provided in the bascule. In the rear, the trigger guard, by means of its hook 14, engages with a trigger guard bolt 19, which has a sear 19' facing forward and interacting with the hook 14. The trigger guard bolt 19 is mounted in the bascule 10, and more precisely in the rear part of the bascule 10, with the possibility of longitudinal sliding, because its sear 19' is able to approach the hook 14 for actively locking the trigger guard 11 and to move away from the hook 14 for unlocking and releasing the trigger guard. A pretensioned spring **19*a* stresses the trigger guard bolt 19 so as to maintain it usually moved forward such that its sear 19' engages with the hook 14. A backward movement of the trigger guard bolt 19 to move its sear 19' away from the hook 14 is brought about by a release device, designated overall as 20, which is mounted in the bascule 10 and controlled by means of the sliding safety catch 15 and the top lever for closing/opening the barrels 16**.

The sliding safety catch 15 can be manually moved into three positions:

- a backward position (not shown) for putting the trigger mechanism on safety by means of its catch part 15';
- an intermediate position A (cf. FIG. **1*a***) for firing, that is, for using the gun; and
- a forward position B (cf. FIG. **2*a*) which enables the release device 20** to release the trigger mechanism.

The closing top lever 18 has a rotation shaft 18' with a radial projection **18*a***, whose function will become clear below.

The sliding safety catch 15 is provided with a peg 21, which interacts with a safety lever 22, which oscillates on a pin 22' and is stressed by a spring **22*a* so as to maintain the safety lever 22 in contact with the peg 21. Starting from its rear end, the safety lever 22 has, in succession, an incline 23, which, with the peg 21, is able to define the safety position (not shown), an intermediate notch 24, which, also with the peg 21, is able to define the firing position A, and a cam protuberance 25, which, with the peg 21**, is able to define the release position B of the trigger mechanism.

An inclinable return pawl 26, which has a first arm facing towards, and interacting with, the sliding safety catch 15 and a second arm facing towards, and interacting with, a release bolt 27, is mounted with a pin 26' on the safety lever 22, in a part between its pin 22' and the cam protuberance 25. The return pawl 26 follows the angular movements of the safety lever 22 and is able to oscillate independently of same.

The release bolt 27 extends, almost horizontally, between the return pawl 26 and the shaft 18' of the closing top lever 18. The release bolt 27 is mounted inclinable on an intermediate pin 27' not connected to the bascule and is also free from longitudinal movements. The bolt 27 has an end nib 28, on which rests the second arm of the return pawl 26, and a head 29 facing towards, and intended for interacting with, the radial projection **18*a* of the shaft 18' of the closing top lever 18**.

A plate 30 attached to the bascule with a pin 30' forms a means of retention at the level of the head 29 of the release bolt 27.

The intermediate pin 27' of the release bolt 27, and thus this bolt as well, is supported by a release lever 31, which is mounted, oscillating in a pendular manner, on a pin 31' fixed in the bascule 10.

On the top, the release lever 31 has a retainer arm 32 intended for resting on the bascule to stop the oscillation in one direction of the lever and to define a resting position for same. On the bottom, the release lever 31 has a push terminal 33 facing towards and intended for interacting with a nose **19*b*, which is made in one piece with the trigger guard bolt 19 and is arranged above the sear 19'**.

The release lever 31 and the release bolt 27 are stressed by a single spring 34, which is arranged and usually acts to maintain:

- the release lever 31 in its resting position and with its push terminal 33 spaced away from the nose **19*b* of the trigger guard bolt 19**; and
- the release bolt 27 rotated on the pin 27' such that its end nib 28 is in contact with the second arm of the return pawl 26 and its head 29 is lowered outside the line of interception by the projection **18*a* of the shaft 18' of the top lever 18**.

Therefore, the release device 20 comprises the return pawl 26, the release bolt 27 and the release lever 31, which form a kinematic mechanism which makes possible the transmission of controls from the sliding safety catch 15 and from the closing top lever 18 to the trigger guard bolt 19 at the time of unlocking the trigger guard 11 for the removal of the trigger mechanism from the bascule.

When the barrels of the gun are closed and the sliding safety catch 15 is in the firing position A (cf. FIG. **1*a*), the release device 20 remains inoperative. Neither the sliding safety catch 15 nor the closing top lever 18 has an effect on the device 20. Thus, and as shown in FIG. 1, the trigger mechanism remains coupled and locked in the bascule thanks to the interaction between the hook 14 of the trigger guard 11 and the sear 19' of the trigger guard bolt 19**.

Figure 2:
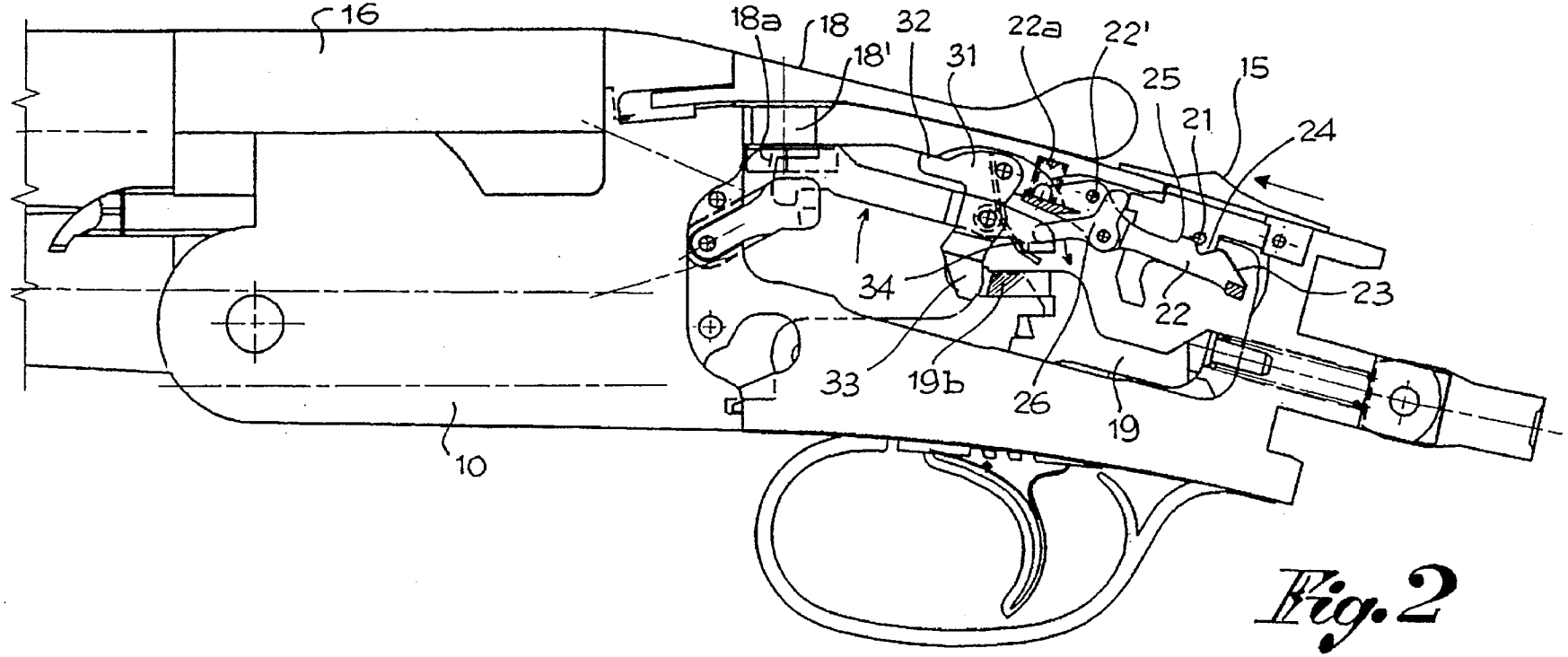
FIG. 2 is a view of the device as in FIG. 1, but with the sliding safety catch moved forward for a first action of unlocking the trigger mechanism.
Figure 2A:
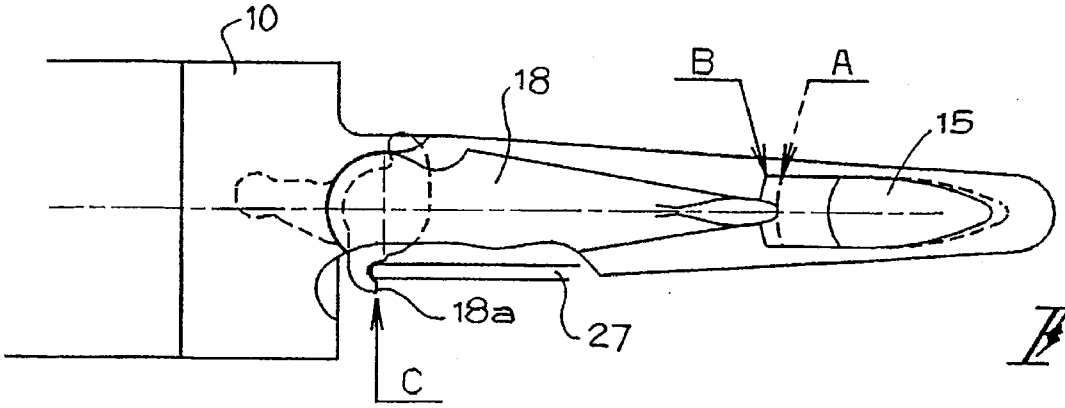
FIG. 2*a* is a top view of the device as in FIG. 2.
Figure 3:
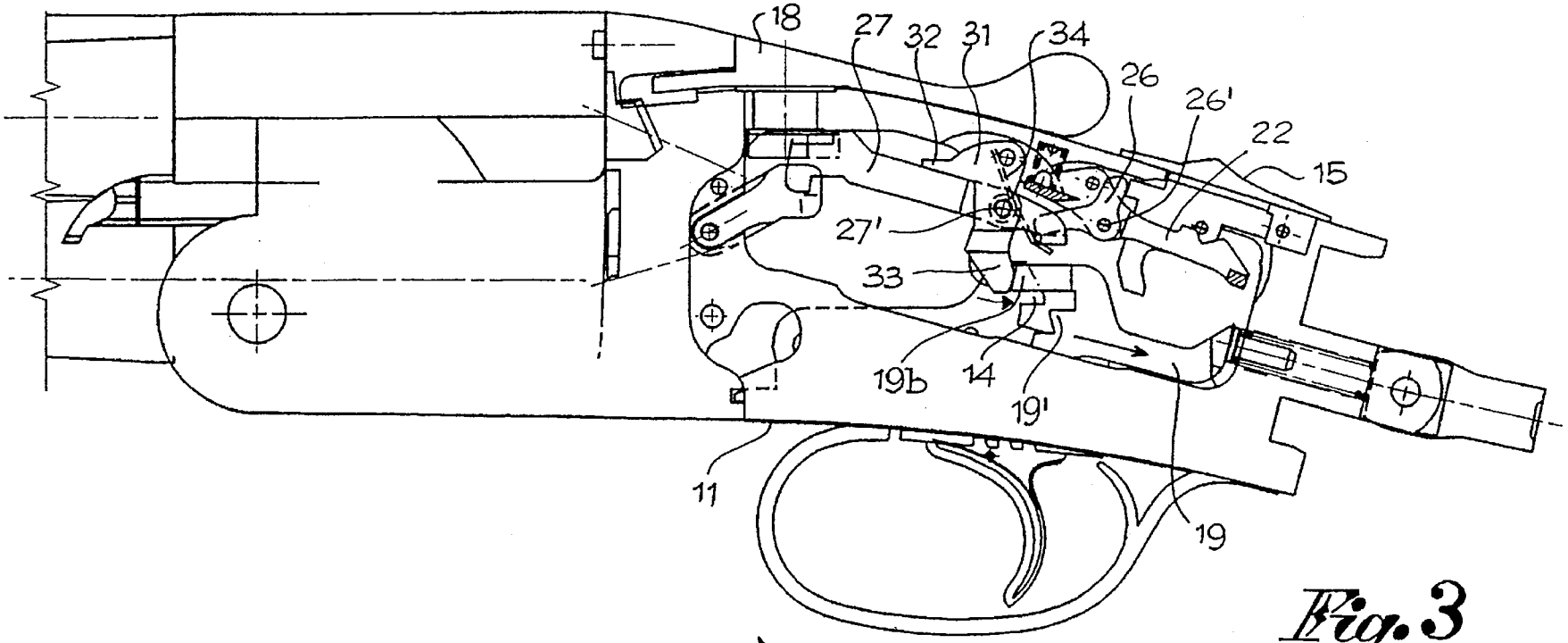
FIG. 3 is a view of the device as in FIG. 2, but with the top lever rotated for a second action of unlocking the trigger mechanism.

To release the trigger guard 11, so as to be able to remove the trigger mechanism from the bascule, it is absolutely necessary to act either on the sliding safety catch 15 or on the closing top lever 18. First, it is necessary to move the sliding safety catch 15 into the forward release position (cf. FIGS. 2, **2*a*); then, while the safety catch is maintained in this position, the top lever 18 is rotated for the opening of the barrels 16 (cf. FIGS. 3, 3*a*). With the movement of the sliding safety catch 15 into position B, the safety lever 22, pushed by the peg 21 which rises on the cam protuberance 25, oscillates towards the bottom; at the same time, the sliding safety catch 15 exerts a push against the first arm of the return pawl 26. This return pawl 26 must rotate on the relative pin 26', and with its second arm, it begins to act on the release bolt 27, causing it to oscillate on the pin 27' so as to be lowered by the end 28 and to be railed by the head 29. The head 29 of the bolt 27 is thus to be released from the retainer plate 30 and supported on the line of interception and interaction with the radial projection 18*a* of the shaft 18' of the closing top lever 18**.

Figure 3A:
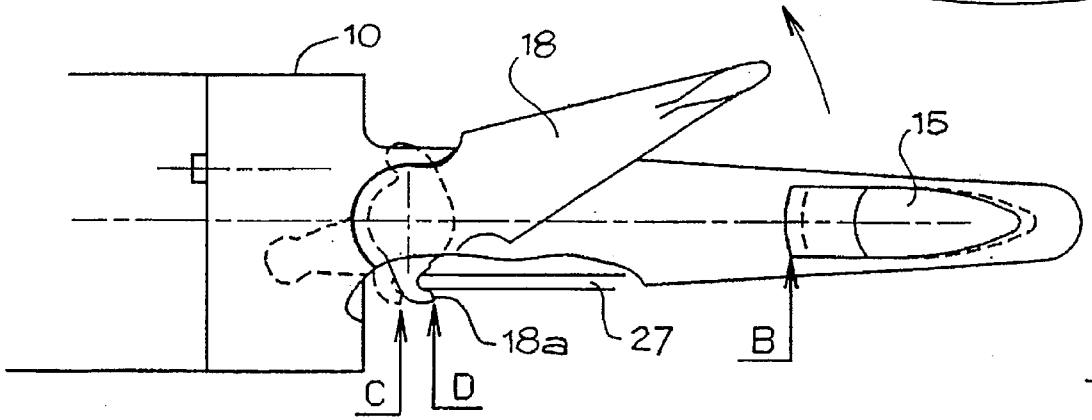
FIG. 3*a* is a top view of the device as in FIG. 3.

Therefore, with the subsequent rotation of the closing top lever 18 to cause the opening of the barrels 16, the projection **18*a* is found to rotate from the position C to the position D shown in FIG. 3*a*. The top lever 18, by means of the projection 18*a*, thus exerts a push in the longitudinal direction on the release bolt 27, which undergoes a linear movement towards the rear. This linear movement of the bolt 27 causes an oscillation of the release lever 31 on the relative fixed pin 31' so as to approach and engage the push terminal 33 against the nose 19*b* of the trigger guard bolt 19**.

On the other hand, the upper retainer arm 32 of the release lever 31 rests on the release bolt 27, leading to a uniting of the two elements 27, 31. Then, these two elements, under the pressure of the radial projection 18*a* of the shaft 18' of the top lever, cause a retrograde movement of the trigger guard bolt 19 against the spring 19*a* and until the sear 19' of the trigger guard bolt 19 moves away from the hook 14 of the trigger guard 11. Thus, the top lever remains stationary in the opening position, maintaining the bolt 19 withdrawn; the user can release the safety catch 15, which returns to the central firing position; the locked top lever when opened holds the bolt 19 back in a stable manner.

Figure 4:
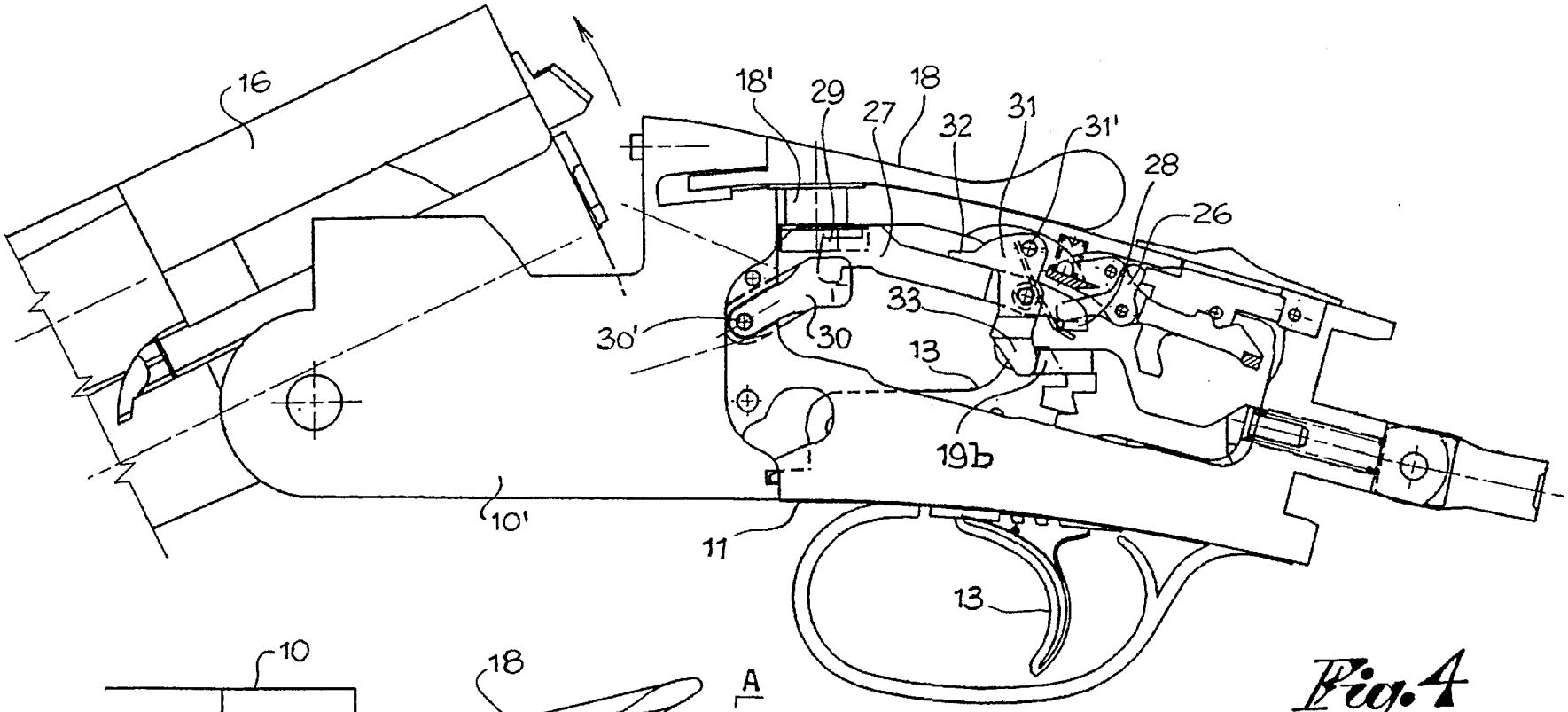
FIG. 4 is a view of the device as in FIG. 3, but with the barrels open, with the return of the sliding safety catch into the initial position and with the trigger mechanism unlocked.
Figure 4A:
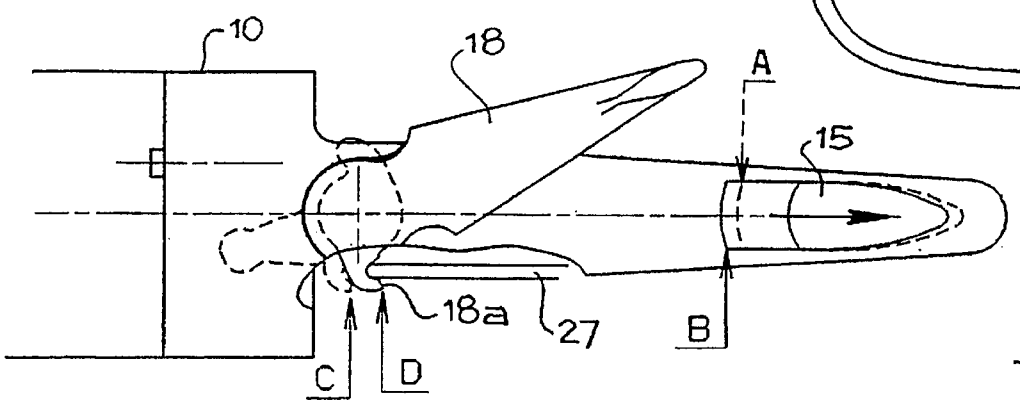
FIG. 4*a* is a top view of the device as in FIG. 4.
Figure 5:
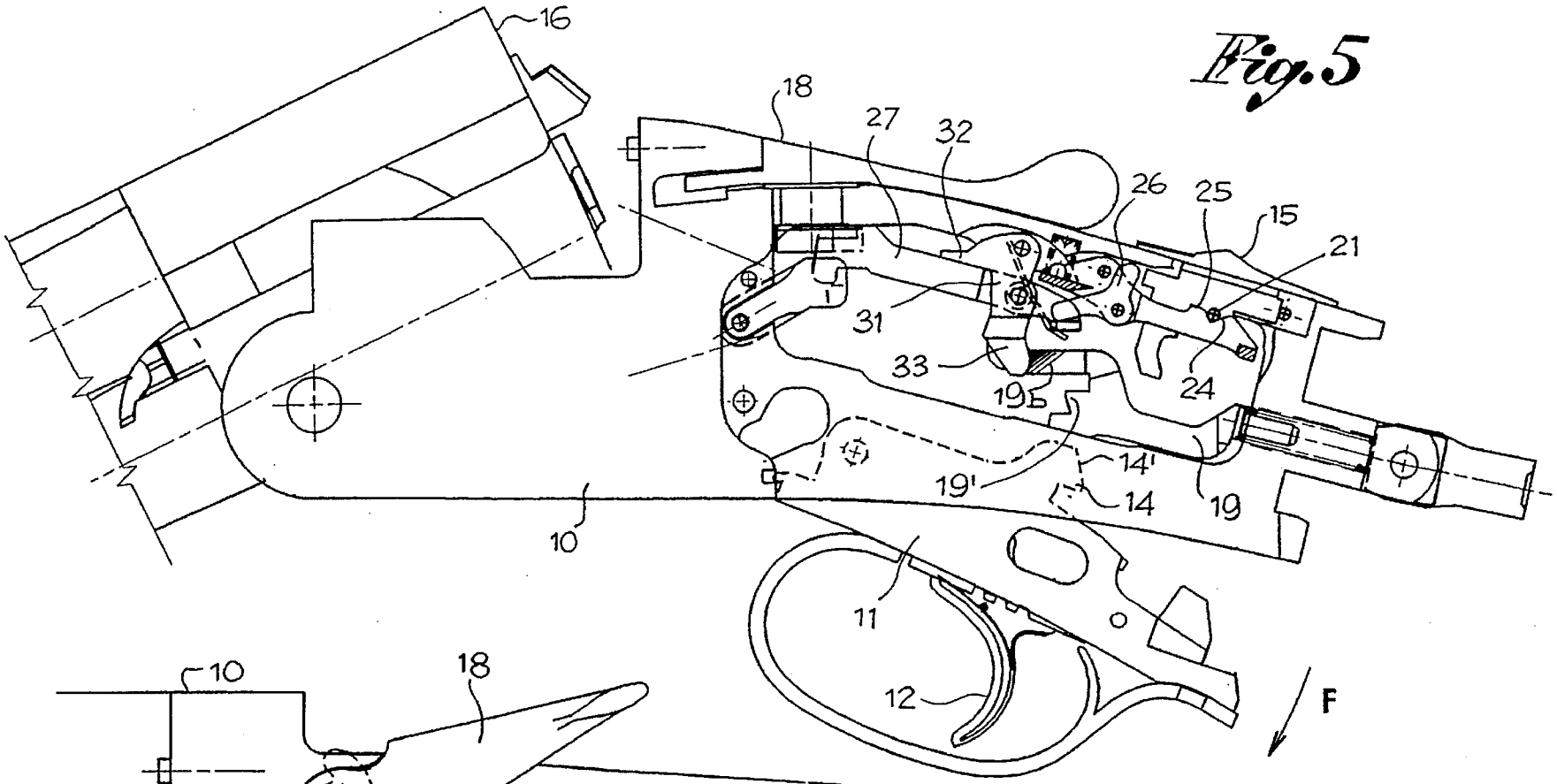
FIG. 5 is a view of the device as in FIG. 4, but in the phase of removal of the trigger mechanism from the bascule, likewise corresponding to the phase of reattachment of the trigger mechanism in the bascule.
Figure 5A:
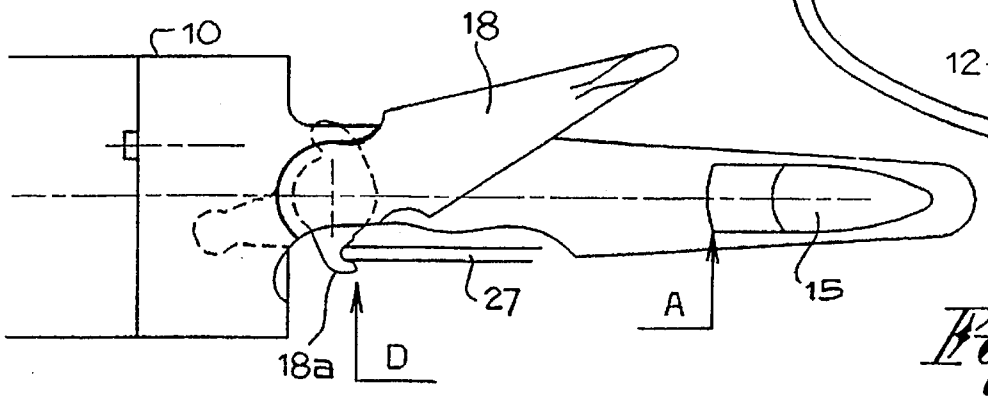
FIG. 5*a* is a top view of the device as in FIG. 5.

The trigger guard 11 is thus released as shown in FIG. 4 and can be freely removed from the base of the bascule according to the arrow F as shown in FIG. 5, while the release device remains in the state which made it possible to release the trigger mechanism as well as in the state which makes it possible to remount the trigger device in the bascule.

Figure 6:
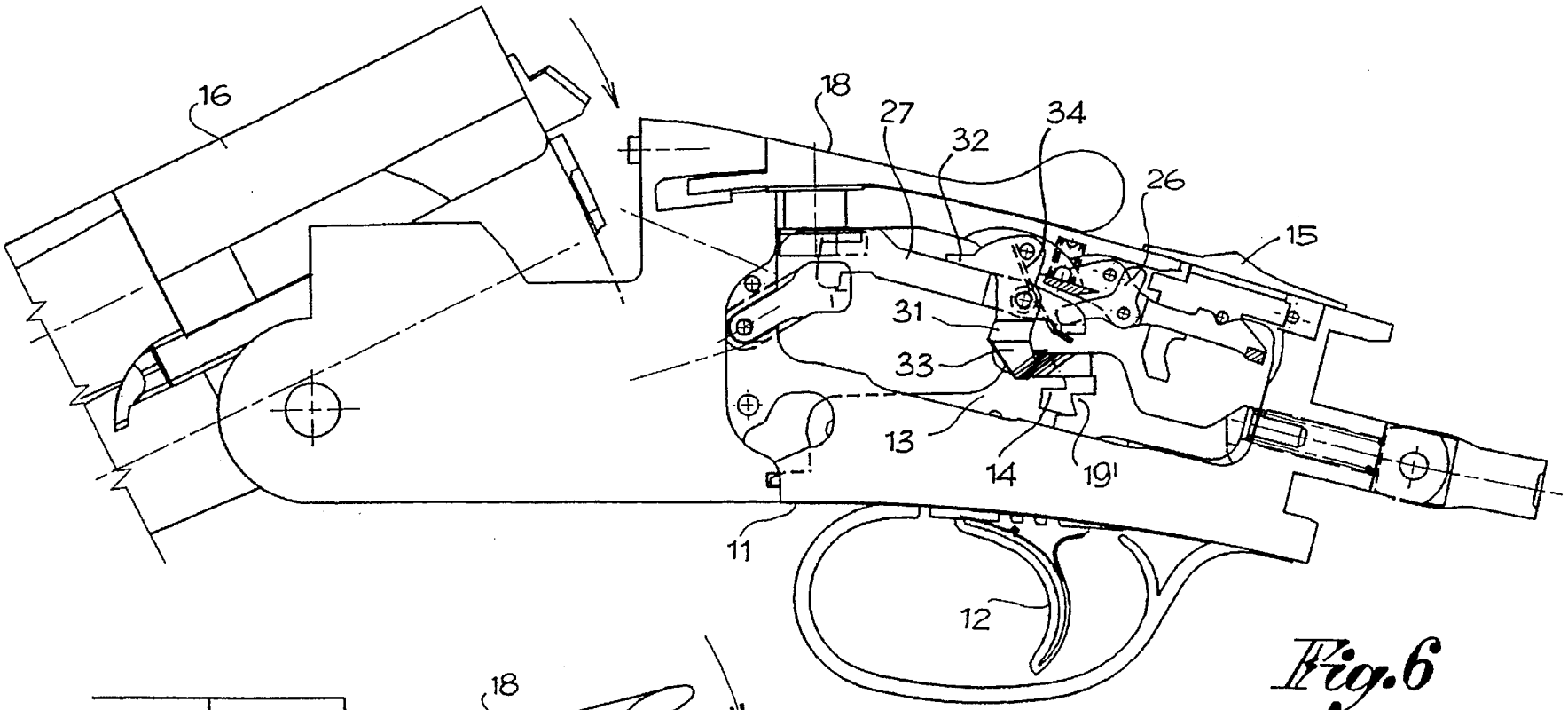
FIG. 6 is a view of the device as in FIG. 5, but with the trigger mechanism attached to the bascule and the barrel in the phase of closing on the bascule.
Figure 6A:
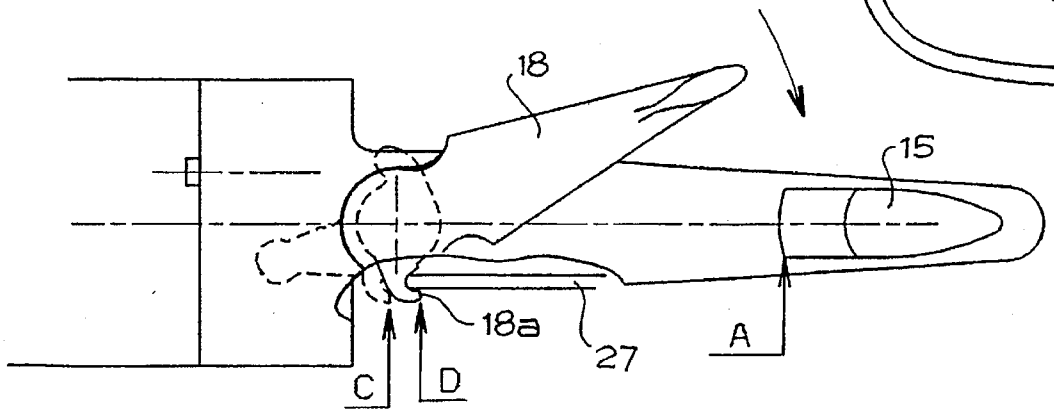
FIG. 6*a* is a top view of the device as in FIG. 6.

For such a remounting, the trigger mechanism may be reattached to the bascule as in FIG. 6 after which, with the closing of the barrels and the return (cf. FIG. 6) of the top lever to the locking position, the release device will return to the initial position of FIG. 1, making it possible for the trigger guard bolt 19 to move forward and for its sear 19' to engage with the hook 14' for the active locking of the trigger mechanism.

As is evident from the above, the trigger mechanism is removed and mounted only with the barrels open, therefore under conditions of safety for the user, whose hands, moreover, shall remain occupied with moving tile sliding safety catch and the closing top lever and therefore away from the trigger.

While a specific embodiment of the invention has been shown and described in detail to illustrate the application of the principles of the invention, it will be understood that the invention may be embodied otherwise without departing from such principles.

What is claimed is:

1. A device for coupling and releasing the trigger mechanism in a bascule of a gun, comprising:

a trigger guard attached to a lower part of said bascule;

a trigger mechanism, elements of said trigger mechanism being premounted on said trigger guard;

a baffle connected to said trigger guard, said baffle extending into said bascule, said baffle having a hook facing toward a rear direction of the gun;

a trigger guard bolt mounted longitudinally movable in said bascule between a forward coupling position and a rearward position for releasing said trigger guard, said trigger guard having a sear, said hook for acting with said sear for movement of said trigger guard;

a sliding safety catch including a catch part for interfering with an element of said trigger mechanism for setting said trigger mechanism in a safety state, said sliding safety catch being mounted and movable on an upper part of said bascule;

a safety lever mounted for oscillating in said bascule, said safety lever being shaped to interact with said sliding safety catch and to define, for said safety catch, a backward safety position, an intermediate firing position and a forward release position;

a top lever interacting with barrels of the gun, said lever being rotatable for movement from a position for locking to a position for unlocking said barrels, said top lever being pivoted on a front part of said bascule; and a kinematic release mechanism extending between said sliding safety catch, said top lever and said trigger guard bolt for moving said trigger guard bolt into said rearward position for releasing said trigger guard from said trigger mechanism upon a consecutive movement of said sliding safety catch from said intermediate firing position to said forward release position and of said closing top lever into a position for unlocking said barrels.

2. A device according to claim 1, wherein said closing top lever includes a rotation shaft with a radial projection for controlling said kinematic release mechanism.

3. A device according to claim 1, wherein said kinematic release mechanism comprises an inclinable return pawl, a release bolt, a release lever and a spring, said spring for simultaneously stressing said bolt and said release lever, said inclinable pawl being provided on said safety lever and having a first arm facing towards and interacting with said sliding safety catch and a second arm facing towards and interacting with said release bolt, said inclinable pawl following a movement of said safety lever and oscillating from a part of said second arm when said sliding safety catch is moved from said intermediate firing position to said forward release position;

said release bolt extending between said inclinable pawl and said shaft of said closing top lever and being mounted in an inclinable manner on an intermediate pin, said intermediate pin being released from said bascule and being movable in a longitudinal direction, said release bolt having an end nib, on which rests said second arm of said inclinable pawl and a head facing towards and intended for interacting with said radial projection of said shaft of said closing top lever when said closing top lever is rotated into an unlocking position for a longitudinal movement towards a rear of said bolt;

said release lever being connected to an intermediate pin of said release bolt and being provided in a pendular manner on a pin attached to said bascule, said release lever having an upper retainer arm for resting a limitation of angular movements relative to said bolt alternately against said bascule and on said release bolt, and a lower push terminal facing towards and interacting with said trigger guard bolt to move said trigger guard bolt into a rearward position for releasing said trigger mechanism followed by a longitudinal movement towards a rear of said bolt for release by said radial projection;

said spring acting so as to maintain said release lever in a resting position and with said push terminal moved away from said trigger guard bolt and said release bolt rotated on said intermediate pin :so that said end nib is in contact with said second arm of said inclinable pawl and said head is outside a line of interception by said projection of said shaft of said closing top lever when said sliding safety catch is not in said forward release position and said top lever is in said position for locking said barrel.

4. A device according to claim 3, wherein said release bolt rests with its head on a retainer plate when said top lever is in said locking position and said head of said bolt is not in alignment with said projection of said shaft, said head of said bolt being in alignment with said projection when said sliding safety catch is in said forward release position.

5. A device according to claim 4, wherein said trigger guard bolt is pushed by said spring into a forward position for locking said trigger guard and has above said sear a nose which extends towards and interacts with said lower push terminal of said release lever.

* * * * *